United States Patent [19]

Kopecky

[11] 4,147,331

[45] Apr. 3, 1979

[54] PLASTER SPRAYING AND CONCRETE MIXING MACHINE

[76] Inventor: Eugene F. Kopecky, 5959 Madra Ave., San Diego, Calif. 92120

[21] Appl. No.: 612,676

[22] Filed: Sep. 12, 1975

[51] Int. Cl.[2] ..... B28C 5/14

[52] U.S. Cl. ..... 366/46; 222/166; 222/383; 366/13; 366/51; 366/53

[58] Field of Search ..... 259/151, 161, 169, 171, 259/174, 175, 9, 10, 45, 46, 93; 222/178, 383, 164, 166

[56] References Cited

U.S. PATENT DOCUMENTS

| | | | |
|---|---|---|---|
| 2,238,051 | 4/1941 | Hackley | 259/151 |
| 2,987,302 | 6/1961 | Terry | 259/171 |
| 3,006,615 | 10/1961 | Mason | 259/151 |
| 3,093,364 | 6/1963 | Schoonover | 259/151 |

*Primary Examiner*—Richard E. Aegerter
*Assistant Examiner*—L. Footland
*Attorney, Agent, or Firm*—Brown & Martin

[57] ABSTRACT

A plaster spraying and concrete mixing machine comprised of a frame chassis, a rotatable top loading horizontally axis mounted drum type mixing tank with a center mounted rotatable mixing shaft and mixing paddles therein, and a gravity fed Moineau type progressive cavity pump mounted to the bottom of the mixing tank for pivoting therewith. A primary power source and driving mechanisms provide for turning of an air compressor, the mixing paddles, and the Moineau pump which enable the machine to mix and spray plasters and other cementitious materials. The embodiment of a selectively rotatable mixing tank provides that the machine can also mix and conveniently fully discharge batches of concrete or mortar. The pump is mounted directly to the bottom of the tank with the drive arrangement permitting the pump to pivot with the mixing tank between its mixing and dumping positions. One drive arrangement includes a drive member coaxial with the pivotal axis of the tank and another drive arrangement permits disconnecting of the pump to permit it to rotate with the tank.

4 Claims, 3 Drawing Figures

PLASTER SPRAYING AND CONCRETE MIXING MACHINE

BACKGROUND OF THE INVENTION

1. Field of the Invention

This invention relates to a machine for mixing and spraying plasters, acoustical materiels, stucco, waterproofing, fireproofing, and other cementitious materiels compatable for pumping by a Moineau type progressive cavity pump. This invention furthur relates to a machine for mixing and conveniently fully discharging batches of concrete or mortar.

2. The Prior Art

In the construction industry, machines for spraying plasters are known. Many provide a simple hopper which is loaded with materiels pre-mixed with water; others provide integral mixing tanks which are permanently affixed to the chassis and are not capable of being rotated to discharge batches of concrete or mortar. The Moineau type pumps mounted are frequently very difficult to reach on the underside of these machines, and are not easily changed or serviced. Other machines, specifically designed for mixing and discharging batches of concrete are also well known, but do not have the ability to pump and spray other materiels.

SUMMARY OF THE INVENTION

In a spraying and mixing machine as described a frame chassis has mounted thereon a rotatable drum type mixing tank with rotatable mixing paddles therein, and a Moineau type pump mounted on the bottom of the tank to receive plasters and other cementitious materiels from the tank for pumping and spraying at a remote location. Means are provided for driving the mixing paddles, Moineau pump, and an air compressor so that the tank may be unlocked from its normally upright position, and rotated about its axis approximately 120 degrees without interference from other components of the machine, it may also be employed for mixing and conveniently fully discharging batches of concrete or mortar.

Accordingly, it is an object of the present invention to provide an improved machine capable of performing all of the heretofore mentioned functions by economically and efficiently combining these capabilities within one machine utilizing the same chassis, power source, and driving mechanisms. Another object is to provide an improved machine wherein the Moineau pump may be more accessable and easily reached for replacement or maintenence. Another object is to provide an improved machine which can be more easily cleaned; wherein wash water within the mixing tank may be easily discharged by rotation of the tank thereby precluding the necessity of either pumping the same out via the Moineau pump or opening drain plugs if so provided. Accordingly, it may be expected that pump longevity can be greatly extended.

DETAILED DESCRIPTION

Figure 1:
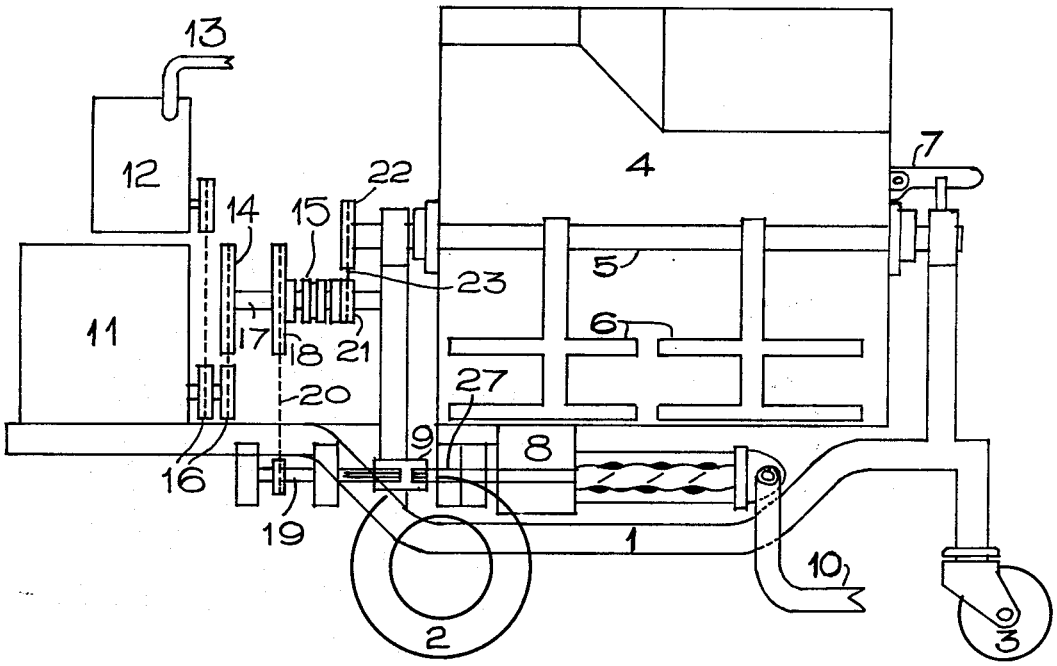
FIG. 1 is a plan side view partially in section of the invention for illustration.
Figure 2:
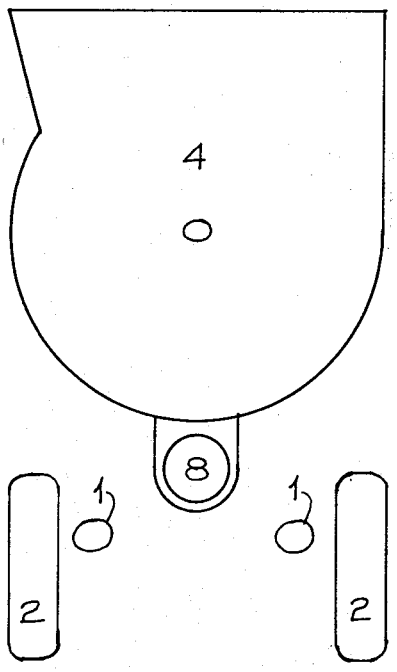
FIG. 2 is a partial plan end view taken on line 2—2 of FIG. 1 illustrating the relative position of the mixing tank when locked upright.
Figure 3:
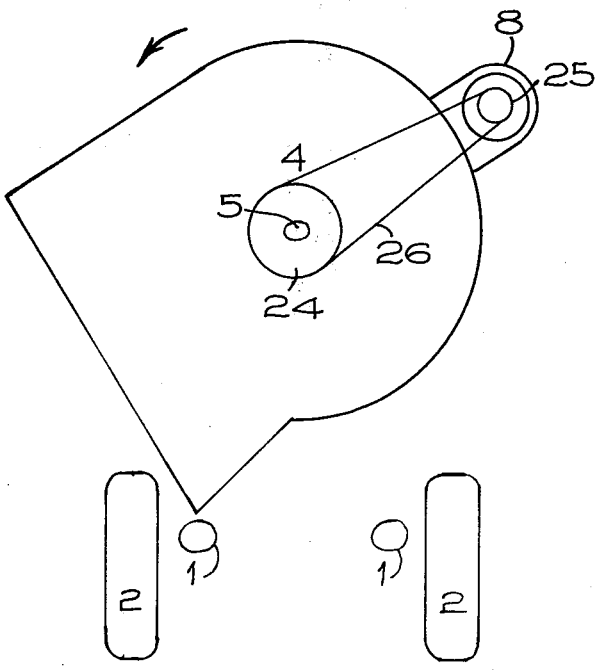
FIG. 3 is a partial plan end view like FIG. 2 illustrating a modification and the relative position of the mixing tank after rotation.

The machine of the present invention has a tubular steel frame chassis (1) with suitably mounted ground wheels (2 and 3). A rotatable top loading drum type mixing tank (4) is horizontally axis mounted above the frame. The tank is mounted on a rotatable mixing shaft (5) extending through its center or axis, to which mixing paddles (6) are affixed. As the tank is normally rotated only for washing or discharging batches of concrete or mortar, when employed for mixing or spraying materiels it is held in an upright position (as shown in FIG. 2) by an articulated tongue type locking mechanism (7) which engages into a vertical slot provided in the frame structure. A disconnectable Moineau type progressive cavity pump (8) is mounted to the underside of the tank, where it can receive mixed materiels from the tank by gravity and pump same via a hose (10) to a spraying head (not shown) at a remote location. The pump can be disconnected from the driving mechanisms (14 and 15) by sliding the splined collar coupler (9) rearward. Other suitable coupling devices may be employed if desired. A primary power source (11) turns an air compressor (12) which supplies air via a hose (13) to the spraying head. The primary power source also turns the driving mechanism (14) which through a suitable clutching mechanism (15) turns the mixing paddles or the Moineau pump. The primary power source 11 may be any suitable engine or motor and is drivingly connected by suitable sprockets or pulleys 16 for driving compressor 12 and sprocket or pulley 14 for turning shaft 17. Rotation of shaft 17 turns pulley or sprocket 18 which turns shaft 19 by way of chain or belt 20 for turning pump shaft 27 of pump 8. The rotation of shaft 17 also rotates sprocket or pulley 21 which drives sprocket or pulley 22 by way of chain or belt 23 for rotating shaft 15 for driving mixing paddles 6. The machine may be selectively employed for mixing and spraying cementitious materiels mixed in the tank with water which are compatable for pumping by the Moineau pump when the tank is retained in the upright position as illustrated in FIG. 1; or for mixing concrete or mortar and conveniently fully discharging such batches when the pump is disconnected and the tank rotated approximately 120 degrees to the position illustrated in FIG. 3. The present invention has anticipated that if the Moineau pump is driven by a final drive mechanism (such as sprockets and chain or pullys and belt) the center of which coincides with the center of the axis of rotation of the mixing tank as illustrated in FIG. 3, then disconnection of the Moineau pump by means of a coupler is not required to allow rotation of the tank. This arrangement is illustrated in FIG. 3, wherein the drive shaft 5 constitutes a common drive member with the mixing paddle 6 and the pump 8. With this arrangement a pulley 24 is mounted on shaft 5 and is drivingly connected to pump 8 by means of a pulley 25 mounted on pump shaft 27 with a suitable belt or chain 26 drivingly connecting the two pulleys 24 and 25. With this arrangement there is no need to disconnect the drive of pump 8 when tilting the mixing tank for dumping as shown in FIG. 3. It remains that to perform all of the functions herein described, the machine must simply provide that the mixing tank may be rotated without interference from the pump or other components of the machine.

I claim as my invention:

1. A mixing and spraying machine, said machine comprising:

a frame, a mixing tank pivotally mounted on said frame for selectively pivoting about a horizontal axis between an upright position and a dumping position, rotatable mixing means mounted within said tank for rotation relative to said mixing tank about said horizontal axis, a gravity fed progressive cavity pump mounted directly on the underside of said mixing tank for pumping material directly from said tank, a prime mover, and drive means for connecting said prime mover for driving said rotatable mixing means and for driving said pump, said drive means being connected to said mixing means and to said pump means so that said pump is free to pivot with said mixing tank between said mixing position and said dumping position.

2. The mixing and spraying machine of claim 1 wherein said drive means includes means for disconnecting said drive means from said pump for permitting said pump to pivot with said mixing tank.

3. The machine of claim 1 wherein said drive means includes a common drive member co-axial with said horizontal axis so that said pump pivots with said mixing tank without disconnecting said drive means.

4. The machine of claim 3 wherein said common drive member is a drive shaft, said mixing means includes paddle means secured to and rotatable with said shaft, and said drive means includes an input shaft for said pump and flexible means for drivingly connecting said drive shaft to said input shaft.

* * * * *